US012624615B2

(12) United States Patent
Ding

(10) Patent No.: US 12,624,615 B2
(45) Date of Patent: May 12, 2026

(54) METHOD OF SIMULATING FLUID FLOWS IN AN UNDERGROUND FORMATION COMPRISING A FRACTURE NETWORK

(71) Applicant: IFP Energies nouvelles, Rueil-Malmaison (FR)

(72) Inventor: Didier Yu Ding, Rueil-Malmaison Cedex (FR)

(73) Assignee: IFP ENERGIES NOUVELLES, Rueil-Malmaison Cedex (FR)

( * ) Notice: Subject to any disclaimer, the term of this patent is extended or adjusted under 35 U.S.C. 154(b) by 993 days.

(21) Appl. No.: 17/848,457

(22) Filed: Jun. 24, 2022

(65) Prior Publication Data

US 2023/0003102 A1 Jan. 5, 2023

(30) Foreign Application Priority Data

Jul. 1, 2021 (FR) ..... 2107120

(51) Int. Cl.
*E21B 41/00* (2006.01)

(52) U.S. Cl.
CPC ..... *E21B 41/00* (2013.01); *E21B 2200/20* (2020.05)

(58) Field of Classification Search
CPC ..... E21B 41/00; E21B 2200/20; E21B 43/00; Y02E 10/10
See application file for complete search history.

(56) References Cited

U.S. PATENT DOCUMENTS 10,344,591 B2 * 7/2019 McNealy ..... E21B 49/00
2009/0164189 A1 * 6/2009 Bourbiaux ..... E21B 43/00 703/10

FOREIGN PATENT DOCUMENTS

WO WO-0058910 A1 * 10/2000 ..... G01V 1/30

OTHER PUBLICATIONS

Aliyu, M., "Numerical Modelling of Geothermal Reservoirs with Multiple Pore Media", Proceedings, 42nd Workshop on Geothermal Reservoir Engineering, Stanford University, California, USA, Feb. 13-15.

Austria, J. et al., "Dual Porosity Models of a Two-phase Geothermal Reservoir", Proceedings World Geothermal Congress 2015, Melbourne, Australia, Apr. 19-25.

(Continued)

*Primary Examiner* — Rehana Perveen
*Assistant Examiner* — Troy A Maust
(74) *Attorney, Agent, or Firm* — Fitch, Even, Tabin & Flannery LLP

(57) ABSTRACT

The present invention is a method of simulating fluid flows in an underground formation comprising a fracture network. A porosity model is constructed, comprising a first medium representative of an unfractured matrix, a second medium representative of fractures oriented in a first direction and a third medium representative of fractures oriented in a second direction orthogonal to the first direction. From at least the porosity model, flow parameters of a grid representation of the formation are determined, which include conduction and convection transmissibilities between two neighboring cells for the second and third media, as well as mass and energy exchanges by convection and conduction between each medium taken two by two for a single cell. Flows in the formation are simulated by f a flow simulator implementing the porosity model.

19 Claims, 6 Drawing Sheets

(56) References Cited

OTHER PUBLICATIONS

Fujii, S., et al., "Development of Geothermal Reservoir Simulator for Predicting Three-dimensional Water-Steam Flow Behavior Considering Non-equilibrium State and Kazemi/MINC Double Porosity System", GRC Transaction, vol. 42.
Omagbon, J, et al., "Experiences in Developing a Dual Porosity Model of the Leyte Geothermal Production Field", Proceedings of 38th New Zealand Geothermal Workshop, Auckland, New Zealand, Nov. 23-25.
Warren, J.E, et al., "The Behavior of Naturally Fractured Reservoirs", SPE Journal, vol. 3, pp. 245-255.
Lemonnier, P., et al., "Simulation of Naturally Fractured Reservoirs. State of the Art", Oil & Gas Science and Technology, vol. 65 (2010), No. 2, pp. 239-262.
Opinion Report for FR2107120 dated Jul. 1, 2021.
Search Report for FR 2107120 dated Mar. 17, 2022.
Designation of Inventors for FR2107120 dated Jul. 1, 2021.
Request Brevet D'Invention for FR2107120 dated Jul. 1, 2021.

* cited by examiner

METHOD OF SIMULATING FLUID FLOWS IN AN UNDERGROUND FORMATION COMPRISING A FRACTURE NETWORK

CROSS REFERENCE TO RELATED APPLICATION

Reference is made to French Application No. 21/07.120 filed Jul. 1, 2021, which is incorporated herein by reference in its entirety.

BACKGROUND OF THE INVENTION

Field of the Invention

The present invention relates to modelling fluid flows in an underground formation comprising a fracture network. The present invention finds a specific application in the field of geothermal energy, but it can also apply to the field of petroleum exploration and exploitation.

Description of the Prior Art

Diversification of the different energy sources allows reduction of fossil fuel dependence and thus meeting the challenges of energy transition. In this context, the global market for geothermal power generation is expected to double in the next ten years.

The geothermal resource exploits the natural geothermal gradient (temperature increase with depth) of the Earth, which may be very variable depending on the sites. Thus, to capture the geothermal energy, a fluid is circulated in the subsoil, at a greater or lesser depth depending on the desired temperature and according to the local thermal gradient. This fluid may be naturally present in the rock (aquifer) or it may be purposely injected into the subsoil. The fluid heats up upon contact with the subsurface rocks and flows back to the surface laden with calories (thermal energy), which is transmitted in a heat exchanger. The fluid is thereafter reinjected into the medium, once cooled and filtered.

Numerical simulation of subsurface flows provides essential information for optimal geothermal energy exploitation. First, such a simulation can be advantageously used prior to building a plant in order to determine the potential of a site considered for geothermal energy exploitation, or to determine the location, the geometry and the depth of injection/production wells. Numerical flow simulation can also be advantageously used for monitoring a geothermal site, notably in order to optimize production while preserving the geothermal potential of this site, or for monitoring interactions with surrounding aquifers.

Sites favorable to geothermal energy exploitation are often found in geologically active zones such as volcanic zones. Such zones are most often characterized by fracture networks, which have a very significant impact on fluid flows as fractures can act as drains or barriers to fluid flows. It is therefore important for the numerical flow simulators used to provide realistic modelling of the flows, including in the case of a fractured medium.

Now, accurate modelling of flows in a fractured medium would require extremely fine cells for modelling heterogeneities such as faults. In order to limit the computing time, approximate fracture medium models have been proposed in the literature relative to petroleum exploration and exploitation.

The following documents are mentioned in the description:

Aliyu, M. D., Chen, H. P., Harireche, O. and Hills, C. D. (2017) "Numerical Modelling of Geothermal Reservoirs with Multiple Pore Media", PROCEEDINGS, 42nd Workshop on Geothermal Reservoir Engineering, Stanford University, California, USA, 13-15 February.

Austria, J. and O'Sullivan, M. (2015) "Dual Porosity Models of a Two-phase Geothermal Reservoir" Proceedings World Geothermal Congress 2015, Melbourne, Australia, 19-25 April.

Fujii, S., Ishigami, Y. and Kurihara, M. (2018) "Development of Geothermal Reservoir Simulator for Predicting Three-dimensional Water-Steam Flow Behavior Considering Non-equilibrium State and Kazemi/MINC Double Porosity System" GRC Transaction, vol. 42.

Omagbon, J., O'Sullivan, M., O'Sullivan, J. and Walker, C. (2016) "Experiences in Developing a Dual Porosity Model of the Leyte Geothermal Production Field" Proceedings of 38th New Zealand Geothermal Workshop, Auckland, New Zealand, 23-25 November Warren, J. E. & Root, P. J. (1963) "The Behavior of Naturally Fractured Reservoirs", SPE Journal, Volume 3, pp. 245-255.

Lemonnier, P. and Bourbiaux, B. (2010) "Simulation of Naturally Fractured Reservoirs. State of the Art Part 2, MatriX-fractures Transfers and Typical Features of Numerical Studies" Oil & Gas Science and Technology, Vol. 65 (2010), No. 2, pp. 263-286.

In the petroleum sector, the dual porosity model, notably described in the document (Warren and Root, 1963), is widely used to simulate flows in fractured reservoirs. This approach involves the fractured reservoir being broken into identical parallelepiped blocks, referred to as matrix blocks, delimited by an orthogonal system of continuous uniform fractures oriented in the principal directions of flow. In a dual porosity model (also referred to as dual medium model), the medium to be modelled is broken into a "fracture" medium and a "matrix" medium.

With such a model, any elementary volume (reservoir model cell) of the fractured reservoir is associated with a fraction of matrix block(s). Fluid flow at reservoir scale occurs essentially through the fractures, fluid exchanges occur locally between the matrix blocks and the fractures, and the amounts of fluid are mainly stored in the matrices. FIGS. 1A and 1B show, by way of illustration, an example of an underground formation with a fracture network RF (FIG. 1A) and an equivalent dual porosity model (FIG. 1B), having parallelepiped blocks B, delimited by a system of fractures RFX, RFY orthogonal to one another.

This type of models is increasingly used in the field of geothermal energy, as described for example in the documents (Austria and O'Sullivan, 2015; Omagbon et al., 2016; Aliyu et al., 2017; Fugii et al., 2018).

However, although the dual porosity model is in general particularly well suited for flow modelling in the petroleum sector, where convection is the main transport mechanism, the dual porosity model is not suited to geothermal fractured reservoirs where the thermal conduction mechanism plays a significant role.

Indeed, the dual porosity model according to the prior art involves by construction that pressure and temperature are constants in a cell within the fracture medium. Although it can be assumed that pressure is locally a constant within the fracture medium, due to the high permeability in the fractures, such an assumption is not suitable for temperature because the thermal conductivity in the fractures is actually very low (as in the matrix). In other words, in a fracture medium, temperature diffusion is much slower than pressure diffusion in the fractures.

Let us consider a square matrix block B as illustrated in FIG. 2A, with a principal flow in direction X, i.e.

$$F_x^f \gg F_y^f,$$

where F is the flow stream. Whatever the direction of flow, the pressure around this matrix block is nearly constant due to the high permeability in the fractures. Therefore, the exchange flow between the matrix and the fractures due to convection is quasi uniform around this block, for the mass flow as well as the heat flow. However, this is not always the case for the temperature and the heat flow due to conduction, notably when cold water is injected into a fractured medium at high temperature (200° C. for geothermal production for example). Indeed, the water front progresses mainly along the fractures oriented in the principal direction of flow, i.e. in direction X. The temperature decreases first in the fractures parallel to direction X and the temperature in the fractures parallel to direction Y changes slowly, which is illustrated in FIG. 2B by the following relations for the temperatures in the fractures:

$$\theta_1^f \approx \theta_2^f \ll \theta_3^f \approx \theta_4^f,$$

where $$\theta_i^f$$

is the temperature in a fracture i, with i=1, 4. Heat exchanges occur mainly between the matrix block and the fractures parallel to direction X due to the low fracture temperature thereof, while exchanges with the fractures parallel to direction Y are limited by the higher fracture temperature. Thus, the heat exchange due to conduction is not uniform in the fractures, which is illustrated in FIG. 2B by the following relations for heat exchanges through conduction:

$$Q_{D1}^{mf} \approx Q_{D2}^{mf} \gg Q_{D3}^{mf} \approx Q_{D4}^{mf}, \text{ where } Q_{Di}^{mf}$$

is a heat exchange due to conduction between matrix and fracture for fracture i, with i=1, 4. The temperature in a fracture depends on the amount of cold water flowing therethrough and on the matrix-fracture exchange. Now, in a dual porosity model according to the prior art, it is not possible to have distinct temperatures depending on the direction of the fractures to calculate the matrix-fracture exchange through conduction. Simulations may therefore be inaccurate.

A dual porosity model according to the prior art thus does not enable proper modelling of the heat transfer by conduction between matrix and fractures. Besides, some authors (Fujii et al., 2018, for example) have observed that the cold water arrival time actually measured at a production well can sometimes be much faster than the time predicted by a numerical flow simulation based on a dual porosity model.

SUMMARY OF THE INVENTION

The present invention aims to overcome these drawbacks. In particular, the present invention relates to a simulation of fluid flows in an underground formation comprising a fracture network, implementing a porosity model allowing improved modelling of heat transfer through conduction in relation to a dual porosity model according to the prior art. More precisely, the porosity model according to the invention breaks the medium to be modelled into a matrix medium, a first "fracture" medium representative of fractures oriented in a first direction and a second "fracture" medium representative of fractures oriented in a second direction orthogonal to the first direction. Such a model allows to distinctly accounting for pressure diffusion and the temperature diffusion in the fracture media according to their direction, and therefore to better model the heat transfer for simulation of the fractured geothermal reservoirs.

The present invention relates to a computer-implemented method of simulating fluid flows in an underground formation comprising a fracture network in order to exploit the fluid of the underground formation wherein, from measured properties relative to the formation, a grid representation of the formation is constructed and at least statistical parameters relative to the fracture network are determined, the method comprising at least the following steps:

A) from at least the statistical parameters relative to the fracture network, constructing a porosity model for the underground formation comprising the fracture network, the porosity model comprising a first medium representative of an unfractured matrix of the formation, a second medium representative of the fractures of the formation oriented in a first direction, and a third medium representative of the fractures of the formation oriented in a second direction, the first and second directions being orthogonal to one another;

B) from at least the measurements of properties relative to the formation, from the statistical parameters relative to the fracture network and from the porosity model, determining flow parameters in each cell of the grid representation, the flow parameters comprising at least:
   - between two neighboring cells in the second direction, a convection transmissibility and a conduction transmissibility of the fluid in the first and second directions in the second medium, the convection and conduction transmissibilities of the fluid being zero in the second direction in the second medium;
   - between two neighboring cells in the first direction, a convection transmissibility and a conduction transmissibility of the fluid in the first and second directions in the third medium, the convection and conduction transmissibilities of the fluid being zero in the first direction in the third medium;
   - within a cell of the grid representation, mass exchanges by convection, energy exchanges by convection and energy exchanges by conduction between the second and third media, between the first and second media, and between the first medium and the third medium;

C) from the grid representation and the flow parameters in each cell of the grid, simulating the flows of the fluid in the underground formation comprising the fracture network by means of a flow simulator implementing the porosity model.

According to an implementation of the invention, the mass exchanges $$F_{w,i}^{ff}$$

by convection between the second and third media in one of the cells i of the grid can be determined with a formula:

$$F_{w,i}^{ff} = \lambda_i^f T_i^{ff}\left(P_i^{fX} - P_i^{fY}\right)$$

where $$T_i^{ff}$$

is a convection transmissibility between the second and third media of the cell i, $$P_i^{fX}$$

and $$P_i^{fY}$$

correspond to a pressure in the second and third media of the cell i respectively, and $$\lambda_i^f$$

is a mobility of the fluid between the second and third media of the cell i.

According to an implementation of the invention, the energy exchanges $$F_{H,i}^{ff}$$

by convection between the second and third media in one of the cells i of the grid can be determined with a formula:

$$F_{H,i}^{ff} = \lambda_i^f H_i^f T_i^{ff}\left(P_i^{fX} - P_i^{fY}\right)$$

where $H_i^f$ is an enthalpy of the fluid between the second and third media of the cell i, $$T_i^{ff}$$

is the convection transmissibility between the second and third media of the cell i, $$P_i^{fX}$$

and $$P_i^{fY}$$

correspond to the pressure in the second and third media of the cell i respectively, and $$\lambda_i^f$$

is the mobility of the fluid between the second and third media of the cell i.

According to an implementation of the invention, the convection transmissibility between the second and third media of the cell i can be determined with a formula:

$$T_i^{ff} = \alpha \sum_{j \in \Omega_i} \left(T_{x,ij}^{fX} + T_{y,ij}^{fY}\right)$$

where α is a multiplier equal to at least 100, preferably at least 1000, $\Omega_i$ is all the cells next to the cell i, $$T_{x,ij}^{fX}$$

corresponds to the convection transmissibility in the first direction in the second medium for the cell i, and $$T_{y,ij}^{fY}$$

corresponds to the convection transmissibility in the second direction in the third medium for the cell i.

According to an implementation of the invention, the energy exchanges $$F_{D,i}^{ff}$$

by conduction between the second and third media in the cell i can be determined with a formula:

$$F_{D,i}^{ff} = G_i^{ff}\left(\theta_i^{fX} - \theta_i^{fY}\right)$$

where $$G_i^{ff}$$

is a conduction transmissibility between the second and third media for the cell i, $$\theta_i^{fX}$$

and $$\theta_i^{fY}$$

correspond to the temperature in the second and third media respectively.

According to an implementation of the invention, the conduction transmissibility between the second and third media for the cell i can be determined with a formula:

$$G_i^{ff} = \Lambda_i^{ff} C_i^{ff}$$

where $$\Lambda_i^{ff}$$

is an arithmetic mean of an effective thermal conductivity of the second and third media, $$C_i^{ff}$$

is a geometric coefficient depending on the dimensions of the cell i, the dimensions of one of the matrix blocks into which the first medium is broken, and the opening of the fractures of the second and third media.

Furthermore, the invention relates to a computer program product downloadable from a communication network and/or recorded on a computer-readable medium and/or processor executable, comprising program code instructions for implementing the computer-implemented method of simulating fluid flows in an underground formation comprising a fracture network, when the program is executed on a computer.

The invention further relates to a method of exploiting a fluid in an underground formation comprising a fracture network, wherein the computer-implemented method is implemented to simulate fluid flows in an underground formation comprising a fracture network as described above, and wherein, from at least the simulation of the flows in the underground formation, an exploitation scheme comprising at least one site for at least one injection well and/or at least one production well is determined for the fluid, and the fluid of the underground formation is exploited at least by drilling the wells of the site and by providing them with exploitation infrastructures.

BRIEF DESCRIPTION OF THE DRAWINGS

Other features and advantages of the method according to the invention will be clear from reading the description hereafter of embodiments given by way of non-limitative example, with reference to the accompanying figures wherein.

DETAILED DESCRIPTION OF THE INVENTION

Figure 1A:
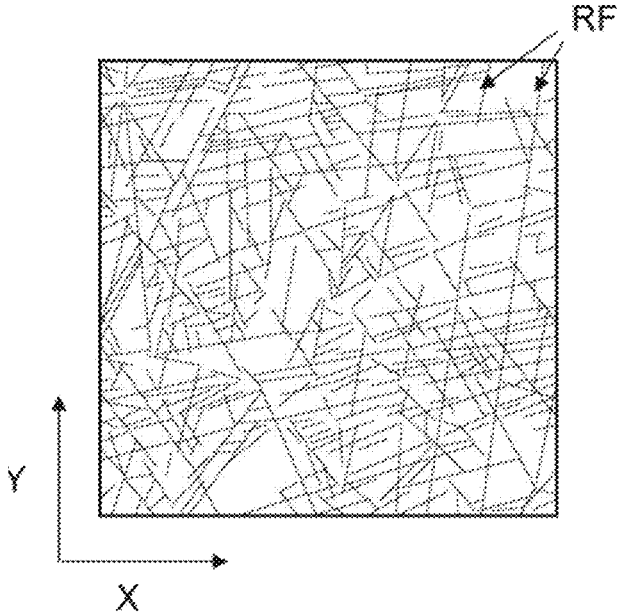
FIGS. 1A and 1B illustrate an example of an underground formation having a fracture network (FIG. 1A) and an equivalent dual porosity model according to the prior art (FIG. 1)
Figure 1B:
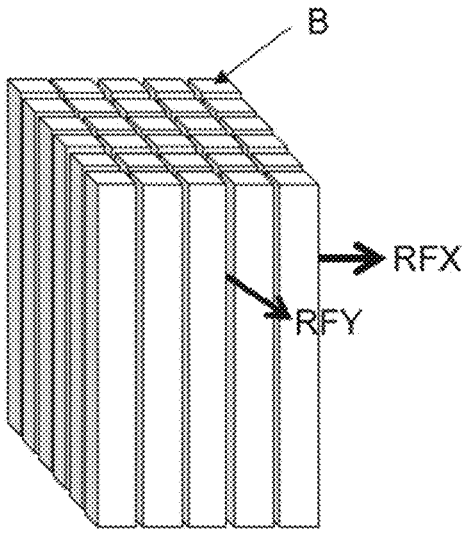
Figure 2A:
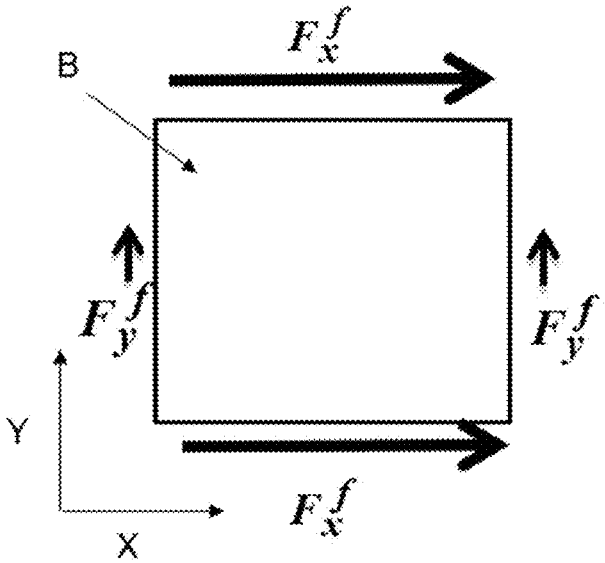
FIGS. 2A and 2B schematically illustrate an example of a matrix block, with the flow streams in the fractures delimiting this block (FIG. 2A), and the temperatures and the heat exchanges by conduction in the fractures of this block (FIG. 2B)
Figure 2B:
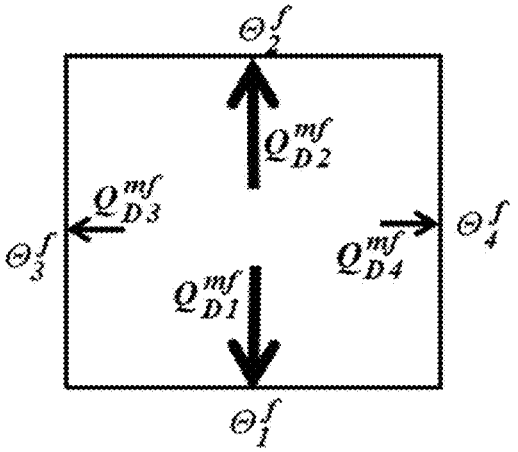

According to a first aspect, the invention relates to a method of simulating fluid flows in an underground formation comprising a fracture network.

The fluid contained in the geological reservoir being studied can be essentially aqueous (water in particular), or it may comprise at least one of an oil phase, a gas phase, and an aqueous phase, and it can possibly contain a polymer or a surfactant.

The underground formation being studied can be a subterranean geological reservoir, fractured in the present case, intended to be subjected to geothermal exploitation for example.

According to a second aspect, the invention relates to a method of exploiting a fluid contained in an underground formation comprising a fracture network, by use of a fluid flow simulation method according to the first aspect of the invention.

It is clear that the simulation method according to the first aspect of the invention is carried out in order to provide simulation results enabling exploitation of the fluid of the underground formation comprising the fracture network according to the second aspect of the invention, by way of non-limitative example, in a geothermal process or in a hydrocarbon recovery process.

The present invention requires:

- property measurements relative to the underground formation being studied: these are, on the one hand, petrophysical property measurements performed in situ or in the laboratory, such as porosity, permeability, lithology (i.e. rock type), relative permeability or capillary pressure. These measurements may have been obtained for example through laboratory analysis of core samples taken in situ, through logging operations carried out in wells traversing the underground formation studied, or through seismic acquisition surveys. On the other hand, these measurements relate to the properties of the fluids flowing through the underground formation studied, such as oil flow rate, water flow rate, pressure or saturation measurements. These measurements may have been obtained for example by producing the fluid in some wells traversing the underground formation being studied, during well tests or interference tests. Generally, such property measurements are well known in the field of flow simulation in an underground formation, a grid representation representative of the underground formation being studied, which is also referred to as reservoir model in the petroleum industry and a subsoil model constructed in order to describe as precisely as possible the structure, the petrophysical properties and the properties of the fluids in the underground formation studied. This model is generally represented on a computer and has a grid, each cell of this grid comprises one or more property values relative to the reservoir being studied (such as porosity, permeability, saturation, geological facies, pressure, etc.). A reservoir model must verify as far as possible the properties collected in the field: logging data measured along wells, measurements performed on rock samples obtained via core drilling for example, data deduced from seismic acquisition surveys, production data such as oil flow rate, water flow rate, pressure variations, etc. Reservoir simulation specialists are fully aware of methods for constructing such a grid representation of a geological reservoir. It is noted that the reservoir model can merge with the geological model when the computing power is sufficient to allow numerical flow simulation calculations on a fine-cell grid. Otherwise, specialists can use an upscaling technique to convert a fine-cell model (geological model) to a model with coarser cells (reservoir model). This upscaling step can be carried out for example with the CobraFlow™ software (IFP Energies nouvelles, France). According to an implementation of the invention, a grid representation of the geological reservoir being studied comprises at least a saturation value, a pressure value, a temperature value, a composition of the fluid mixture, a permeability, a porosity, a capillary pressure, a relative permeability and a pore size in each of the cells thereof;

a flow simulator according to the invention: flow simulator is a numerical program executed on a computer, which is used to simulate fluid flows in a porous medium. Flow simulation, also referred to as reservoir simulation in the petroleum industry, notably allows numerically predicting the displacement over time of a fluid present in at least one of injected into an underground formation, and in particular the amount of fluid produced from a production well (towards which the fluid is displaced by pressure gradient and from where it can be extracted). The flow simulator according to the invention, which notably implements a porosity model according to the invention, is described in detail in step 4) hereafter.

According to an implementation of the invention, the method according to the invention comprises at least the following steps:

1) Fracture network characterization
2) Construction of a porosity model
3) Determination of flow parameters
4) Flow simulation
5) Exploitation of the underground formation fluid.

According to an implementation of the invention, the method according to the first aspect of the invention comprises at least steps 2) to 4). According to an implementation of the invention, the method according to the second aspect of the invention comprises at least steps 2) to 5). Step 1) can be carried out a single time, for the underground formation considered, prior to applying steps 2) to 4) (optionally steps 2) to 5)) that can be repeated without repeating step 1).

1) Fracture Network Characterization

This step characterizes the fracture network of the underground formation being studied, from the property measurements relative to the formation. Advantageously, this step may have been carried out beforehand, a single time, prior to carrying out at least steps 2) to 4) below.

1.1) Determining Statistical Parameters

This substep determines statistical parameters (referred to as PSF) such as fracture orientation or fracture density, characterizing the fracture network of the underground formation being studied. This substep requires property measurements relative to the formation enabling direct or indirect fracture characterization. Information on the fracturation of an underground formation can be obtained via:

core samples taken from the formation being studied, from which a statistical study of the intersected fractures can be performed, and/or outcrops, which have the advantage of providing a large-scale vision of the fracture network, and/or seismic images allowing identifying major geological events and the geometry of the various structures of the formation.

Preferably, fracture statistical parameters are determined in order to best characterize the fractures present in the formation, and the parameters can be selected from among the density of the fractures observed, their length, spatial orientation, opening, permeability and distribution within the layer studied.

Statistical parameters that describe the fracture network of the formation being studied are thus obtained. These parameters can be used to determine cells representative of the grid representation (see optional substep 1.2) and/or a discrete fracture network model (see optional substep 1.3), at the scale of a cell of the grid or of a cell representative of the grid.

1.2) Determining Representative Cells (Optional)

This substep is optional and determines at least one cell representative of a group of cells of the grid.

According to an implementation of the invention, a group of cells of the grid is set up according to a criterion based on the characteristics of the fracture network present in the cells, by means of a semblance measurement for example. Thus, the cells grouped into a group of cells have similar characteristics in terms of fractures. This semblance analysis can be carried out, without being limited thereto, from the statistical parameters that describe the fracture network, these parameters being determined in substep 1.1.

According to an implementation of the invention, a representative cell is assigned to the group of cells of the grid thus set up. By way of non limitative example, any cell of the group of cells or a cell whose characteristics (fracture orientation for example) are close to the average of the characteristics of the group of cells considered can be assigned to the group of cells.

According to an embodiment of the invention, after this step, a group of cells has been set up, so that any cell of the grid has been assigned to a group of cells, each group of cells being associated with a representative cell.

It may be of advantage to consider a cell representative of a group of cells to save computational time and computer memory. Indeed, required calculations can for example be carried out in a step or a substep for the representative cell considered, and the result of these calculations can then be assigned to each cell of the group of cells, thus saving computational time and computer memory.

1.3) Constructing a Discrete Fracture Network Model (Optional)

This substep is optional and constructs a realistic image of the fracture network characterized by the statistical parameters (PSF) determined in substep 1.1, using a discrete fracture network (DFN) model.

This substep can be carried out for a cell of the grid or for a representative cell of a group of cells of the grid as appropriate (see optional substep 1.2), and it can be repeated for each cell of the grid or for each representative cell of groups of cells of the grid as appropriate (see optional substep 1.2).

Thus, in this substep, a detailed representation (DFN) of the inner complexity of the network fracture, as faithful as possible to the direct and indirect reservoir observations, is associated with at least one given cell.

Known softwares, such as the FRACAFlow® software (IFP Energies nouvelles, France), can be used to construct a discrete fracture network (DFN) model in at least one cell of the grid.

2) Construction of a Porosity Model

This step constructs a porosity model (that is a model representative of porosity) of the underground formation comprising the fracture network (that is the fracture medium), from at least the fracture statistical parameters.

In this step, a porosity model of the underground formation is constructed, which comprises a first medium representative of an unfractured matrix of the formation being studied, a second medium representative of the formation fractures oriented in a first direction, and a third medium representative of the formation fractures oriented in a second direction, the first and second directions being orthogonal to one another.

In other words, in this step, the underground formation comprising the fracture network is broken into a set of unfractured matrix blocks (that is a block of a matrix only and comprising no fracture) delimited by two distinct fracture media orthogonal to one another. Thus, the porosity model according to the invention breaks the single fracture medium of the dual porosity model according to the prior art into two distinct fracture media.

In the rest of the description, for the purpose of simplification, the first medium is referred to as "matrix medium", the second and third media are referred to as "fracture media", and the porosity model according to the invention is referred to as "dual porosity-dual fracture model". Besides, the fracture medium representative of the fractures oriented in the first direction is referred to as "X-fracture" medium and the fracture medium representative of the fractures oriented in the direction perpendicular to the first direction is referred to as "Y-fracture" medium.

It is clear that the dimensions of the parallelepiped blocks of the matrix medium can be different from the dimensions of the grid cells. Thus, in general, the dimension of a parallelepiped block of the matrix medium can be greater than or less than the dimension of a cell of the grid, and vice versa. Therefore, the boundaries of the parallelepiped blocks may not correspond to the boundaries of the cells of the grid.

According to an implementation of the invention, one of the directions of the fracture media can correspond to the principal direction of flow, and the other direction corresponds to the direction perpendicular to the principal direction of flow. The principal direction of flow can be determined from the fracture statistical parameters determined at least from at least one of in step 1) and more generally from the property measurements relative to the formation being studied.

According to an implementation of the invention, the size of the parallelepiped blocks of the unfractured matrix medium of the dual porosity-dual fracture model according to the invention can be determined in a similar way to any of the methods implemented in the case of a dual porosity model according to the prior art. For example, the methods described in the documents FR-2,757,957, corresponding to U.S. Pat. No. 6,064,944 and FR-2,923,930, corresponding to U.S. Pat. No. 8,688,424 can be used, which describe a method of calculating the characteristic dimension of a matrix block, representative of unfractured rock blocks, from a discrete fracture network model, an image analysis and interpolation of an invasion curve. Alternatively, the method described in the document FR-3,045,868 (U.S. Pat. No. 10,641,923) can also be carried out.

3) Determination of Flow Parameters

In this step, flow parameters in each cell of the grid representation are determined from at least the porosity model according to the invention, the statistical parameters of the fracture network and the property measurements relative to the formation.

According to the invention, the flow parameters determined in this step comprise at least:

- between two neighboring cells of the grid in direction X, a fluid transmissibility by convection and a fluid transmissibility by conduction in directions X and Y in the X-fracture medium, fluid transmissibilities by convection and by conduction being zero in direction Y in the X-fracture medium;
- between two neighboring cells of the grid in direction Y, a fluid transmissibility by convection and a fluid transmissibility by conduction in directions X and Y in the Y-fracture medium, fluid transmissibilities by convection and by conduction being zero in direction X in the Y-fracture medium;
- within a cell of the grid, mass exchanges by convection, energy exchanges by convection and energy exchanges by conduction between the X-fracture medium and the Y-fracture medium, and between the matrix medium and the X-fracture medium, and between the matrix medium and the Y-fracture medium.

Thus, the porosity model according to the invention allows describing distinct mass and energy exchanges depending on the direction of the fractures which is unlike the dual porosity model according to the prior art. Indeed, the first fracture medium allows describing exchanges in a first direction, and the second fracture medium allows describing exchanges in a second direction. The two fracture media are connected to each cell and the mass can be freely transferred by convection between the two fracture media within a cell. In addition, the porosity model according to the invention is suited to account for a slower temperature diffusion in one fracture direction than in the other.

In detail hereafter embodiments are described wherein flow parameters are determined for a given cell i, or between a cell i and a neighboring cell j. These calculations therefore need to be repeated so as to cover all the cells of the grid.

In the rest of the description below, superscript m represents the matrix medium, superscript fX is the X-fracture medium, superscript fY is the Y-fracture medium, superscript ff is the exchange between the X-fracture and Y-fracture media, superscript mfX is the exchange between the matrix medium and the X-fracture medium, and superscript mfY is the exchange between the matrix medium and the Y-fracture medium.

3.1) Flow Parameters Related to Exchanges in the X-Fracture Medium

Hereafter embodiments are described wherein flow parameters related to fluid exchanges in the X-fracture medium between two neighboring cells i and j are determined.

According to the invention, between two neighboring cells i and j in direction Y, a convection transmissibility $$T_{y,ij}^{fX}$$

and a conduction transmissibility $$G_{y,ij}^{fX}$$

in direction Y are zero in the X-fracture medium, which can be written as follows:

$$T_{y,ij}^{fX} = 0$$

$$G_{y,ij}^{fX} = 0$$

According to an implementation of the invention, between two neighboring cells i and j in direction X, convection transmissibility $$T_{x,ij}^{fX}$$

and conduction transmissibility $$G_{x,ij}^{fX}$$

in direction X in the X-fracture medium can be written as follows:

$$T_{x,ij}^{fX} = K_{x,ij}^{fX}\frac{\Delta y \Delta z}{\Delta x_{ij}}$$

$$G_{x,ij}^{fX} = \Lambda_{x,ij}^{fX}\frac{\Delta y \Delta z}{\Delta x_{ij}}$$

where $\Delta y$ is the size of neighboring cells i and j in direction Y, $\Delta z$ is the size of neighboring cells i and j in direction Z (the size of neighboring cells i and j is the same in directions Y and Z), $\Delta x_{ij}$ is the distance between the centres of neighboring cells i and j, $$K_{x,ij}^{fX}$$

is the effective permeability in direction X of the X-fracture medium between neighboring cells i and j, and $$\Lambda_{x,ij}^{fX}$$

is the effective thermal conductivity in direction X of the X-fracture medium. It is noted that effective permeability $$K_{x,ij}^{fX}$$

is identical to that of the fracture medium in direction X of the dual porosity model according to the prior art, and effective thermal conductivity $$\Lambda_{x,ij}^{fX}$$

is also identical to that of the fracture medium of the dual porosity model according to the prior art. Thus, the transmissibilities $$T_{x,ij}^{fX}$$

and $$G_{x,ij}^{fX}$$

described above respectively correspond to the convection and conduction transmissibilities in direction X of the dual porosity model according to the prior art.

According to an implementation of the invention, the pore volume $$V_i^{fX}$$

of a cell i in the X-fracture medium can be determined with a formula of the type:

$$V_i^{fX} = \frac{w_{fx}/L_y}{w_{fx}/L_y + w_{fy}/L_x} V_i^f$$

where $L_x$ is the matrix block size in direction X, $L_y$ is the matrix block size in direction Y, $w_{fx}$ is the fracture opening in direction X, $w_{fy}$ is the fracture opening in direction Y, $$V_i^f$$

is the pore volume of cell i of the fracture medium according to the prior art, which can be written:

$$V_i^f = \phi_f \Delta x \Delta y \Delta z, \text{ with } \phi_f$$

being the effective porosity of the fracture medium according to the prior art.

3.2) Flow Parameters Related to Exchanges in the Y-Fracture Medium

Hereafter embodiments are described wherein flow parameters related to fluid exchanges in the Y-fracture medium between two neighboring cells i and j are determined.

According to the invention, between two neighboring cells i and j in direction X, convection transmissibility $$T_{x,ij}^{fY}$$

and conduction transmissibility $$G_{x,ij}^{fY}$$

in direction X are zero in the Y-fracture medium, which can be written as follows:

$$T_{x,ij}^{fY} = 0$$

$$G_{x,ij}^{fY} = 0$$

According to an implementation of the invention, between two neighboring cells i and j in direction Y, convection transmissibility $$T_{y,ij}^{fY}$$

and conduction transmissibility $$G_{y,ij}^{fY}$$

in direction Y in the Y-fracture medium can be written as follows:

$$T_{y,ij}^{fY} = K_{y,ij}^{fY} \frac{\Delta x \Delta z}{\Delta y_{ij}}$$

$$G_{y,ij}^{fY} = \Lambda_{y,ij}^{fY} \frac{\Delta x \Delta z}{\Delta y_{ij}}$$

where $\Delta x$ is the size of neighbouring cells i and j in direction X, $\Delta z$ is the size of neighboring cells i and j in direction Z (the size of neighboring cells i and j is the same in directions Y and Z), $\Delta y_{ij}$ is the distance between the centres of neighboring cells i and j, $$K_{y,ij}^{fY}$$

is the effective permeability in direction Y of the Y-fracture medium between neighboring cells i and j, and $$\Lambda_{y,ij}^{fY}$$

is the effective thermal conductivity in direction Y of the Y-fracture medium. It is noted that effective permeability $$K_{y,ij}^{fY}$$

is identical to that of the fracture medium in direction Y of the dual porosity model according to the prior art, and effective thermal conductivity $$\Lambda_{y,ij}^{fY}$$

is also identical to that of the fracture medium in direction Y of the dual porosity model according to the prior art. Thus, the transmissibilities $$T_{y,ij}^{fX}$$

and $$G_{y,ij}^{fX}$$

described above respectively correspond to the convection and conduction transmissibilities in direction Y of the dual porosity model according to the prior art.

According to an implementation of the invention, the pore volume $$V_i^{fY}$$

of the Y-fracture medium in cell i can be determined with a formula of the type:

$$V_i^{fY} = \frac{w_{fy}/L_x}{w_{fx}/L_y + w_{fy}/L_x} V_i^f.$$

3.3) Flow Parameters Related to Exchanges Between the X-Fracture Medium and the Y-Fracture Medium Hereafter embodiments are described wherein flow parameters related to fluid exchanges between the two X-fracture and Y-fracture media are determined for a cell i. Between these two media, pressure diffusion is very fast due to the high fracture permeability, but temperature diffusion is slow due to the low thermal conductivity. The flow parameters defined below account for this physical reality.

According to an implementation of the invention, mass exchanges by convection between the X-fracture and Y-fracture media in a cell i, denoted by $$F_{w,i}^{ff},$$

can be determined with a formula:

$$F_{w,i}^{ff} = \lambda_i^f T_i^{ff} \left(P_i^{fX} - P_i^{fY}\right)$$

where $$T_i^{ff}$$

is the convection transmissibility between the X-fracture and Y-fracture media, $$P_i^{fX}$$

and $$P_i^{fY}$$

correspond to the pressure in the X-fracture and Y-fracture media respectively, and $$\lambda_i^f$$

is the fluid mobility between the two fracture media of cell i.

According to an implementation of the invention, fluid mobility $$\lambda_i^f$$

can be determined by a numerical upwind uncentered scheme, according to the direction of flow (or the pressure values):

$$\lambda_i^f = \begin{cases} \dfrac{\rho_i^{fX}}{\mu_i^{fX}} & \text{if } P_i^{fX} \geq P_i^{fY} \\ \dfrac{\rho_i^{fY}}{\mu_i^{fY}} & \text{otherwise} \end{cases}$$

where $$\rho_i^{fX}$$

and $$\rho_i^{fY}$$

are the fluid densities in cell i in the X-fracture and Y-fracture media respectively, and $$\mu_i^{fX}$$

and $$\mu_i^{fY}$$

are the fluid viscosities in the X-fracture and Y-fracture media of cell i respectively.

According to an implementation of the invention, energy exchanges by convection between the X-fracture and Y-fracture media in cell i, denoted by $$F_{H,i}^{ff},$$

can be determined with a formula:

$$F_{H,i}^{ff} = \lambda_i^f H_i^f T_i^{ff} \left(P_i^{fX} - P_i^{fY}\right)$$

where $$H_i^f$$

is the enthalpy between the X-fracture and Y-fracture media, $$T_i^{ff}$$

is the convection transmissibility between the X-fracture and Y-fracture media, $$P_i^{fX}$$

and $$P_i^{fY}$$

correspond to the pressure in the X-fracture and Y-fracture media respectively, and $$\lambda_i^f$$

is the fluid mobility between the two fracture media of cell i. According to an implementation of the invention, term $$\lambda_i^f H_i^f$$

can be determined by means of a numerical upwind uncentered scheme as follows:

$$\lambda_i^f H_i^f = \begin{cases} \frac{\rho_i^{fX}}{\mu_i^{fX}} H_i^{fX} & \text{if } P_i^{fX} \geq P_i^{fY} \\ \frac{\rho_i^{fY}}{\mu_i^{fY}} H_i^{fY} & \text{otherwise} \end{cases}$$

where $$H_i^{fX}$$

is the fluid enthalpy in the X-fracture medium of cell i, and $$H_i^{fY}$$

is the fluid enthalpy in the Y-fracture medium of cell i.

According to an implementation of the invention, energy exchanges by conduction between the X-fracture and Y-fracture media in cell i, denoted by $$F_{D,i}^{ff},$$

can be determined with a formula:

$$F_{D,i}^{ff} = G_i^{ff}\left(\Theta_i^{fX} - \Theta_i^{fY}\right)$$

where $$G_i^{ff}$$

is the conduction transmissibility between the X-fracture and Y-fracture media, which can be determined with a formula:

$$G_i^{ff} = \Lambda_i^{ff} C_i^{ff}$$

where $$\Lambda_i^{ff}$$

is an arithmetic mean of the effective thermal conductivity of the X-fracture and Y-fracture media, $$C_i^{ff}$$

is a geometric coefficient one determination method of which is described hereafter, and $$\Theta_i^{fX}$$

and $$\Theta_i^{fY}$$

correspond to the temperature in the X-fracture and Y-fracture media respectively.

Advantageously, a convection transmissibility $$T_i^{ff}$$

between the X-fracture and Y-fracture media at least 100 times greater and preferably at least 1000 times greater than the sum of the transmissibilities around cell i can be used, which can be written as follows:

$$T_i^{ff} = \alpha \sum_{j \in \Omega_i} \left(T_{x,ij}^{fX} + T_{y,ij}^{fY}\right)$$

where $\Omega_i$ is all the cells next to cell i, $\alpha$ is a multiplier equal to at least 100, preferably at least 1000, $\Omega_i$ is all the cells next to cell i, $$T_{x,ij}^{fX}$$

corresponds to the convection transmissibility in direction X in the X-fracture medium, and $$T_{y,ij}^{fY}$$

corresponds to the convection transmissibility in direction Y in the Y-fracture medium.

A great convection transmissibility value $$T_i^{ff}$$

allows fast pressure diffusion between these two fractured media. This provides free convection transfer, without barriers, between the two fractured media. Pressures $$P_i^{fX}$$

and $$P_i^{fY}$$

in the two media are thus quasi-identical.

According to an implementation of the invention, a geometric coefficient $$C_i^{ff}$$

relative to the conduction between the X-fracture and Y-fracture media at the scale of cell i can be determined with a formula of the type:

$$C_i^{ff} = \frac{V_{Gi}}{V_b} C_b$$

where $V_b$ is the volume of the matrix block, $V_{Gi}$ is the geometric volume of cell i, and $C_b$ is a geometric coefficient relative to the exchange by thermal conduction between the X and Y fractures around a matrix block. Geometric coefficient $C_b$ thus is at matrix block scale, whereas coefficient $$C_i^{ff}$$

is at cell scale. According to an implementation of the invention, geometric coefficient $C_b$ at matrix block scale can be determined with a formula of the type:

$$\frac{4}{C_b} = \frac{1}{C_{bx}} + \frac{1}{C_{by}}$$

where $C_{bx}$ is a geometric coefficient between an X fracture and a vertex of the matrix block (point of connection between a fracture oriented in direction X and a fracture oriented in direction Y), $C_{by}$ is the geometric coefficient between a Y fracture and the vertex of the matrix block. According to an implementation of the invention, geometric coefficients $C_{bx}$ and $C_{by}$ between an X fracture and the vertex of a matrix block and between a Y fracture and the vertex of a matrix block respectively can be determined with formulas of the type:

$$C_{bx} = \frac{w_{fx}/2}{L_x/4}$$

$$C_{by} = \frac{w_{fy}/2}{L_y/4}$$

where $w_{fx}$ and $w_{fy}$ correspond to the fracture opening in directions X and Y respectively, $L_x$ and $L_y$ correspond to the matrix block size in direction X and direction Y respectively. Thus, geometric coefficient $$C_i^{ff}$$

is a function of the numerical discretization related to the grid pattern, the matrix block dimensions and the fracture opening.

Conduction transmissibility $$G_i^{ff}$$

is thus proportional to the thermal conductivity and to the fracture openings, and it is inversely proportional to the block sizes. Since the thermal conductivity is low and the fracture openings are small, the conduction transmissibility is usually low, which makes thermal diffusion very slow between the two fracture media, and there may be two different temperatures in the two media.

3.4) Flow Parameters Related to Exchanges Between the Matrix Medium and the Fracture Media Hereafter embodiments are described wherein flow parameters related to exchanges between the matrix medium and the X-fracture and Y-fracture media are determined for a cell i.

According to an implementation of the invention, the mass exchange by convection between the matrix medium and the X-fracture medium $$Q_{w,i}^{mfX}$$

in a cell i can be determined with a formula of the type:

$$Q_{w,i}^{mfX} = \lambda_i K^m V_{Gi} \sigma_X \left(P_i^m - P_i^{fX}\right)$$

where $K^m$ is the matrix permeability, $V_{Gi}$ is the geometric volume of cell i, $\sigma_x$ is a form factor for the exchange between the matrix medium and the X-fracture medium one determination method of which is described below, $$P_i^m$$

is the pressure in the matrix block and $$P_i^{fX}$$

is the pressure in the X-fracture medium, $\lambda_i$ is the fluid mobility in cell i. According to an implementation of the invention, fluid mobility $\lambda_i$ in cell i can be determined by a numerical upwind uncentered scheme using a formula of the type:

$$\lambda_i = \begin{cases} \dfrac{\rho_i^m}{\mu_i^m} & \text{if } P_i^m \geq P_i^{fX} \\ \dfrac{\rho_i^{fX}}{\mu_i^{fX}} & \text{otherwise} \end{cases}$$

where $$\rho_i^m$$

is the fluid density in the matrix medium in cell i and $$\mu_i^m$$

is the fluid viscosity in the matrix medium in cell i.

According to an implementation of the invention, energy exchange by convection between the matrix medium and the X-fracture medium $$Q_{H,i}^{mfX}$$

in a cell i can be determined with a formula of the type:

$$Q_{H,i}^{mfX} = \lambda_i H_i K^m V_{Gi} \sigma_X \left(P_i^m - P_i^{fX}\right)$$

where H, is the fluid enthalpy in cell i, $K^m$ is the matrix permeability, $V_{Gi}$ is the geometric volume of cell i, $\sigma_X$ is a form factor for the exchange between the matrix medium and the X-fracture medium one determination method of which is described below, $$P_i^m$$

is the pressure in the matrix block and $$P_i^{fX}$$

is the pressure in the X-fracture medium, $\lambda_i$ is the fluid mobility in cell i. According to an implementation of the invention, term $\lambda_i H_i$ in cell i can be determined by means of a numerical upwind uncentered scheme using a formula of the type:

$$\lambda_i H_i = \begin{cases} \dfrac{\rho_i^m}{\mu_i^m} H_i^m & \text{if } P_i^m \geq P_i^{fX} \\ \dfrac{\rho_i^{fX}}{\mu_i^{fX}} H_i^{fX} & \text{otherwise} \end{cases}$$

where $$H_i^m$$

is the fluid enthalpy in the matrix medium of cell i. According to an implementation of the invention, energy exchange by conduction between the matrix medium and the X-fracture medium $$Q_{D,i}^{mfX}$$

in a cell i can be determined with a formula of the type:

$$Q_{D,i}^{mfX} = \Lambda^m V_{Gi} \sigma_X \left(\Theta_i^m - \Theta_i^{fX}\right)$$

where $\Lambda^m$ is the effective thermal conductivity in the matrix medium, $$\theta_i^m$$

is the temperature in the matrix block and $$\Theta_i^{fX}$$

is the temperature in the X-fracture medium.

According to an implementation of the invention, the mass exchange by convection between the matrix medium and the Y-fracture medium $$Q_{w,i}^{mfY}$$

in a cell i can be determined with a formula of the type:

$$Q_{w,i}^{mfY} = \lambda_i K^m V_{Gi} \sigma_Y \left(P_i^m - P_i^{fY}\right)$$

where $\sigma_y$ is the form factor for the exchange between the matrix medium and the Y-fracture medium one determination method of which is described below, $$P_i^m$$

is the pressure in the matrix block and $$P_i^{fy}$$

is the pressure in the Y-fracture medium.

According to an implementation of the invention, the energy exchange by convection between the matrix medium and the Y-fracture medium $$Q_{H,i}^{mfY}$$

in a cell i can be determined with a formula of the type:

$$Q_{H,i}^{mfY} = \lambda_i H_i V_{Gi} K^m \sigma_Y \left(P_i^m - P_i^{fY}\right)$$

According to an implementation of the invention, the thermal exchange by conduction between the matrix medium and the Y-fracture medium $$Q_{D,i}^{mfY}$$

in a cell i can be determined with a formula of the type:

$$Q_{D,i}^{mfY} = \Lambda^m V_{Gi} \sigma_Y \left(\Theta_i^m - \Theta_i^{fY}\right)$$

where $$\Theta_i^m$$

is the temperature in the matrix block and $$\Theta_i^{fY}$$

is the temperature in the Y-fracture medium.

According to an implementation of the invention, form factors $\sigma_X$ and $\sigma_Y$ involved in the calculation of the transfer between matrix and fractures in directions X and Y respectively can be determined with formulas of the type:

$$\sigma_X = \frac{L_x^2}{L_x^2 + L_y^2}\sigma$$

$$\sigma_Y = \frac{L_y^2}{L_x^2 + L_y^2}\sigma$$

where $L_x$ is the matrix block size in direction X, $L_y$ is the matrix block size in direction Y, and $\sigma$ is the form factor of the dual porosity model according to the prior art.

The person skilled in the art is fully conversant with calculation of the form factor of a dual porosity model according to the prior art. According to an implementation of the invention, reference can be made to the document (Lemonnier, P. and Bourbiaux, B., 2010) for this calculation.

4) Flow Simulation

According to the invention, fluid flows in the formation are simulated using the grid representation comprising the flow parameters determined in step 3), and a flow simulator implementing the porosity model according to the invention determined in step 2).

In general, at any time t of the simulation, a flow simulator solves all of the flow equations specific to each cell and delivers a values solution to the unknowns (saturations, pressures, concentrations, temperature, etc.) predicted at this time t. This solution notably provides knowledge of the amounts of fluid produced and of the state of the underground formation (pressure distribution, saturations, temperatures, etc.) at the time considered.

The flow simulator, also referred to as reservoir simulator, according to the invention allows at least accounting for a dual porosity-dual fracture model as described in step 2) above, and of flow parameters in each cell of the grid representation as determined in step 3) above. In other words, the flow simulator according to the invention is at least capable of considering that each cell of the grid representation is broken into matrix blocks surrounded by fractures, the fractures being represented by a first medium representative of fractures oriented in a first direction and by a second medium representative of fractures oriented in a second direction perpendicular to the first direction. Besides, the flow simulator according to the invention allows accounting for the flow parameters in connection with the dual porosity-dual fracture model according to the invention as defined in step 3) above.

The flow simulator according to the invention allows to reliably predict fluid flows in an underground formation comprising a fracture network.

It is clear that the method according to the invention comprises steps carried out using an equipment (a computer workstation for example) including data processing means (a processor) and data storage means (a memory, in particular a hard drive), as well as an input and output interface for data input and method results output.

In particular, the data processing means are configured for implementing the simulation of flows within the geological reservoir studied, by means of a flow simulator according to the invention as described above.

Besides, the invention relates to a computer program product downloadable from a communication network and/or recorded on a computer-readable medium and/or processor executable, comprising program code instructions for carrying out at least steps 2) to 4) described above, when the program is executed on a computer.

5) Exploitation of the Underground Formation Fluid

This step is carried out within the context of the method according to the second aspect of the invention, which relates to a method for exploiting a fluid contained in the underground formation studied.

In the field of geothermal energy exploitation, it determines at least one exploitation scheme for an essentially aqueous fluid injected into the underground formation being studied. More precisely, in the context of geothermal energy, the heat or the energy of the fluid injected into the formation and recovered is to be exploited.

In the petroleum sector, it determines at least one exploitation scheme for the hydrocarbons contained in the underground formation studied.

In general, an exploitation scheme comprises a number, a geometry and a site (position and spacing) for the injection and production wells to be drilled through the reservoir studied and to be equipped.

In the petroleum sector, an exploitation scheme can further comprise a type of enhanced recovery of the hydrocarbons contained in the reservoir, such as recovery through injection of a solution containing one or more polymers, CO2 foam, etc. An optimum hydrocarbon reservoir exploitation scheme must for example allow to have a high recovery rate for the hydrocarbons trapped in the geological reservoir, over a long exploitation time, and requiring a limited number of wells. In other words, evaluation criteria is predefined according to which a geological reservoir fluid exploitation scheme is considered to be efficient enough to be implemented for the geological reservoir studied.

According to the invention, the exploitation scheme for the hydrocarbons of the underground formation being studied is determined by the flow simulator according to the invention, by implementing notably the dual porosity-dual fracture model as described in step 2) above, and using the flow parameters as described in step 3) above. Such a reservoir simulator can be established from the PumaFlow® (IFP Energies nouvelles, France) flow simulator.

According to an implementation of the invention, various exploitation schemes are defined for the fluid contained in the geological reservoir being studied and at least one criterion allowing evaluation the quality of these exploitation schemes is estimated by the flow simulator according to the invention.

According to an implementation in the petroleum sector, the evaluation criterion can be the amount of fluid produced with each of the various exploitation schemes, the curve representative of the production evolution over time in each well, the gas-oil ratio (GOR), etc. The scheme according to which the hydrocarbons contained in the reservoir are really exploited can then correspond to the one meeting at least one of the evaluation criteria of the various exploitation schemes. According to an implementation of the invention, a plurality of flow simulations is performed for a plurality of injection-production well sites using the simulator according to the invention and the porosity models determined and parametrized in each cell of the grid representation, and the site meeting at least one of the predetermined evaluation criteria is then selected. Advantageously, flow simulations can also be carried out for enhanced recovery types, by using the simulator according to the invention and of the porosity models determined and parametrized in each cell of the grid representation, the exploitation scheme according to which the fluid of the geological reservoir is to be exploited for each enhanced recovery type is then determined, and the enhanced recovery meeting at least one of the predetermined evaluation criteria is then selected. Then, once the exploitation scheme is determined, the hydrocarbons trapped in the petroleum reservoir are exploited according to this exploitation scheme, notably at least by drilling the injection and production wells of the exploitation scheme thus determined, and by setting up the production infrastructures required for developing this reservoir. In cases where the exploitation scheme was further determined by estimating the reservoir production associated with different enhanced recovery types, the type(s) of additives (polymer, surfactant, CO2 foam) selected as described above are injected into the injection well.

According to an implementation in the field of geothermal energy, the evaluation criterion can be the energy or the temperature of the fluid produced following each of the various exploitation schemes, the amount of fluid produced following each of the various exploitation schemes, etc. The scheme following which the fluid is exploited for geothermal energy exploitation purposes can then correspond to the one meeting at least one of the evaluation criteria of the various exploitation schemes. According to the invention, flow simulations are carried out for injection-production well sites, using the simulator according to the invention and porosity models determined and parametrized in each cell of the grid representation, and the exploitation scheme meeting at least one of the predetermined evaluation criteria is selected.

Once the exploitation scheme determined, the injection and production wells of the thus determined exploitation scheme are drilled, and the production infrastructures required for developing this geothermal site are set up.

The exploitation scheme can of course keep developing over the duration of an exploitation, depending on the reservoir knowledge acquired during exploitation, the improvements in the various technical fields involved in an exploitation (improvements in the field of drilling, enhanced recovery for example).

EXAMPLES

Features and advantages of the method according to the invention will be clear from reading the application example hereafter.

For this application example, an underground formation is considered for geothermal exploitation, comprising two fracture families, one oriented in direction X (principal direction of flow) and the other oriented in direction Y. The fracture network spacing in direction X is 25 m and the fracture network spacing in direction Y is 100 m. The permeability in the fractures parallel to direction X is 4 D and the permeability in the fractures parallel to direction Y is 6 D. The permeability of the matrix is 0.0001 mD. The dimensions of the zone wherein flows are to be modelled are 500 m×500 m×10 m. The initial temperature of this reservoir is 200° C. and its initial pressure is 255 bar.

A grid representation of this reservoir consisting of 20 cells in direction X and 20 cells in direction Y, with a cell size of 25 m×25 m×10 m, is first constructed.

From statistical parameters relative to the fracture network, a dual porosity-dual fracture model according to the invention is constructed by considering a decomposition of the underground formation into 100-m matrix blocks in direction X and 25-m matrix blocks in direction Y, each block being delimited by fractures in direction X and fractures in direction Y. Thus, the dual porosity-dual fracture model according to the invention constructed for this application example comprises a matrix medium, a first fracture medium whose fractures are oriented in direction X (X-fracture medium) and a second fracture medium, distinct from the first fracture medium, whose fractures are oriented in direction Y (Y-fracture medium).

Figure 3:
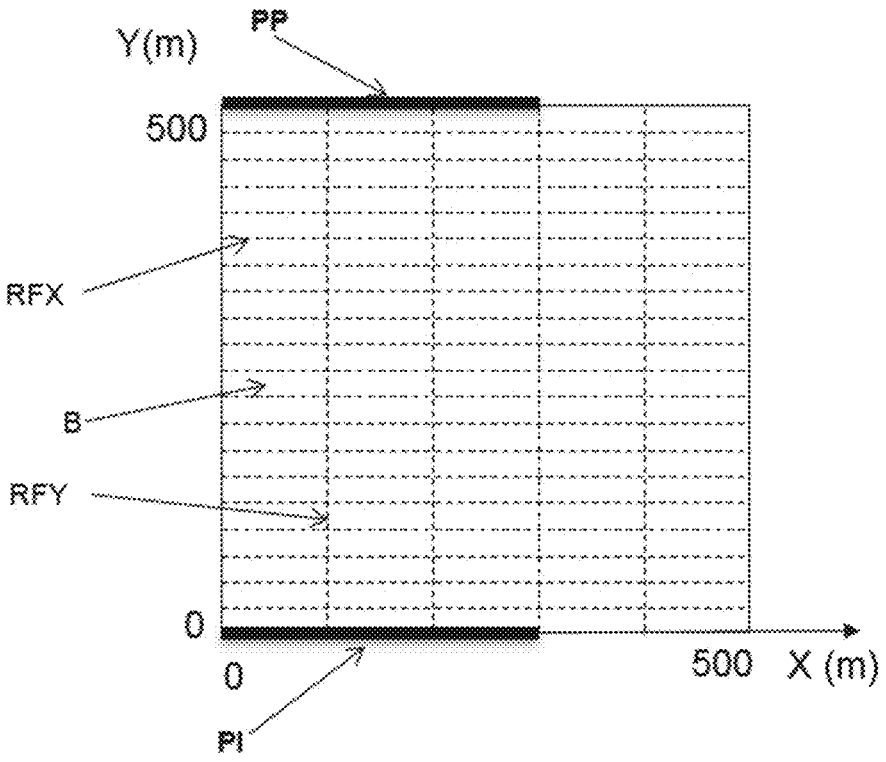
FIG. 3 shows a section at constant depth of the fracture network in an example of a fractured reservoir.

FIG. 3 illustrates a constant-depth section in the fractured medium considered for this application example, a depth at which two horizontal wells PI, PP (shown by two thick black lines at the edges of the fractured medium in direction X) are drilled, oriented in direction X and 300-m long, one of the wells being an injection well PI and the other being a production well PP. FIG. 3 also shows the distribution of matrix blocks B, of fractures RFX oriented in direction X and fractures RFY oriented in direction Y of the porosity model constructed for this application example. The fracture opening is 1 cm. Water at 80° C. is injected at a rate of 50,000 kg/day into injection well PI and a flow of 50,000 kg/day is produced through production well PP. The pressure limit at the bottom of the production well is 50 bar.

A reference model is generated to evaluate the quality of the flow modelling using the porosity model according to the invention. A flow simulation is therefore carried out on a grid representation where the cells are explicitly discretized. In other words, a flow simulation is performed using a grid representation with very fine grid cells (1 cm for discretizing the fault opening and about 10 cm for discretizing the matrix medium in the zone close to fractures), thus enabling realistic prediction of the flows in such a medium. It is clear that the computing times required for such a flow simulation cannot routinely be envisaged, unlike flow simulations performed using dual porosity or dual porosity-dual fracture type models, which allow coarser grid cells to be used.

For comparison purposes, a dual porosity model according to the prior art, which breaks the underground formation into 100 m×25 m×10 m matrix blocks delimited by a single fracture medium, is also constructed.

Figure 4:
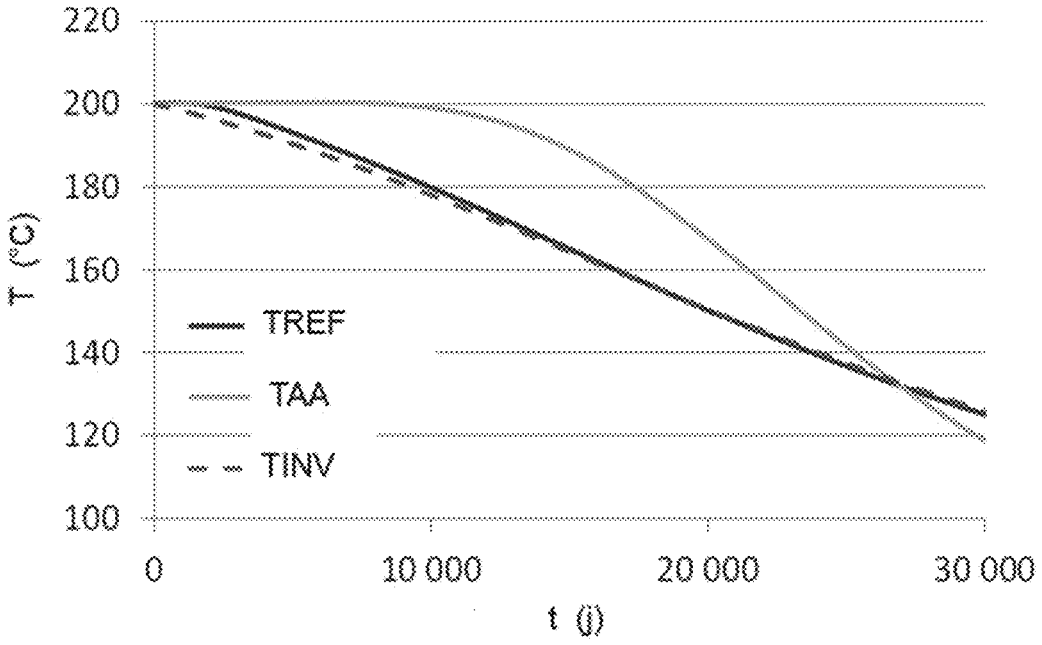
FIG. 4 compares the evolution over time of the temperature of the produced water at a production well, simulated with a flow simulator implementing a porosity model according to the prior art, a flow simulator implementing a porosity model according to the invention and a simulator using a reference model (TREF)

FIG. 4 compares the evolution over time t (in days j) of temperature T of the water in the production well, simulated by means of a flow simulator implementing the dual porosity model according to the prior art (curve TAA), a flow simulator implementing the dual porosity-dual fracture model according to the invention (curve TINV) and a flow simulator using directly the reference model (TREF) (without using an equivalent porosity model).

The reference model shows a rather premature thermal breakthrough due to the high permeability in the fractures in direction Y.

However, it is noted that the model obtained with the dual porosity model according to the prior art is characterized by a very late thermal breakthrough, compared with the reference model. Indeed, the heat exchange between matrix and fractures is overestimated due to the low temperature in the fracture cells of the dual porosity model. In addition, it can be seen that, after 10,000 days, the temperature of the produced water still is at the initial value of 200° C., whereas the temperature in the reference model has decreased down to 180° C. This can be explained by the fact that, with a dual porosity model according to the prior art, the cold water is assumed to flow through all the fractures of the single fracture medium, and the temperature decreases in all these fractures uniformly. Thus, the heat exchange between matrix and fractures is overestimated with a dual porosity model according to the prior art due to a lower fracture temperature. The cold water front is further heated by the overestimated transfer, and the thermal breakthrough is thus delayed.

On the other hand, it can be observed that the dual porosity-dual fracture model according to the invention provides a model that is closer to the reference model because this model makes it possible to calculate different fracture temperatures within a single cell, depending on their orientations, which allows a more accurate matrix-fracture exchange to be obtained.

Figure 5:
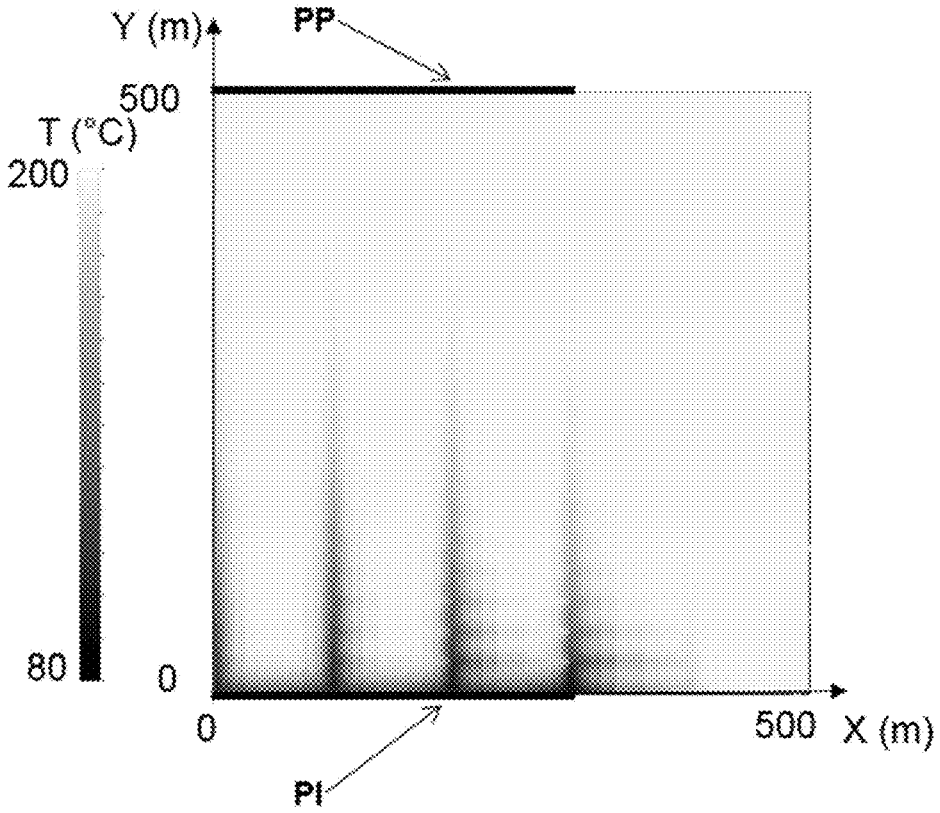
FIG. 5 shows the temperature variations of the water in directions X and Y, obtained using the reference model, after 1000 days.
Figure 6:
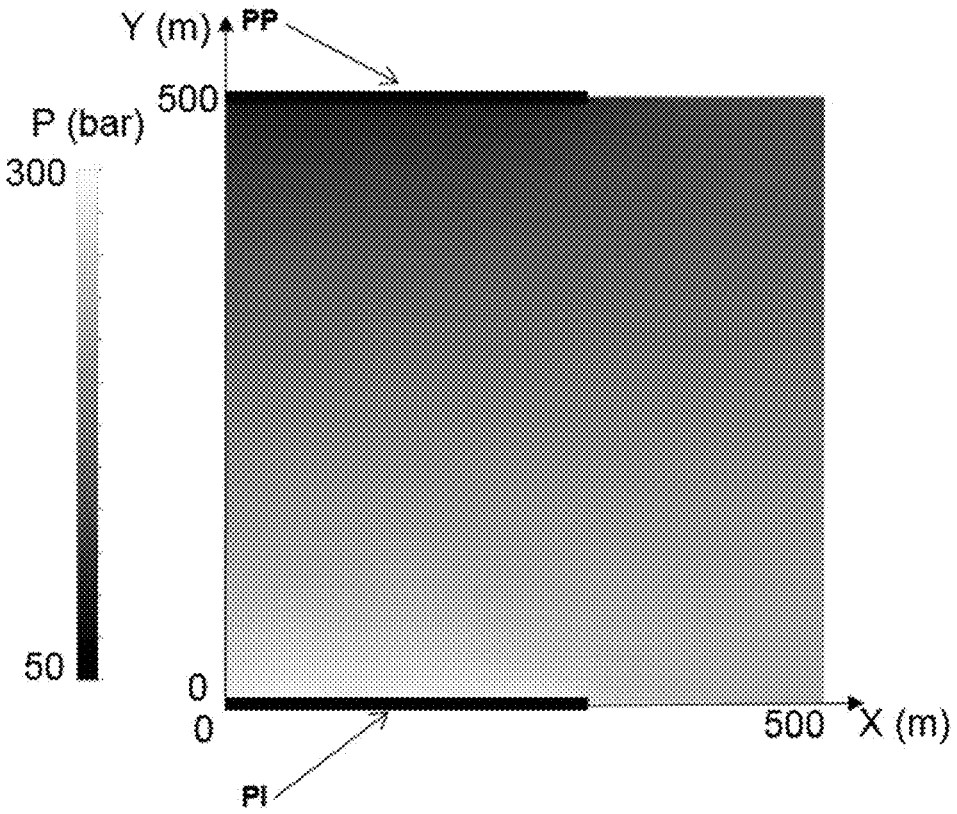
FIG. 6 shows the pressure variations of the water in directions X and Y, obtained using the reference model, after 1000 days.

FIG. 5 and FIG. 6 respectively show the variations of temperature T and pressure P of the water in directions X and Y, obtained with the reference model after 1000 days. It can be noted that the cold water moves rapidly along the fractures oriented in direction Y between injection well PI and production well PP, because the exchange surfaces between a matrix block and the fractures in this direction are relatively small for heat exchange. The temperature along the fractures in direction X varies very slowly due to the large exchange surface with the matrix block and to poor thermal connections between the fractures in directions X and Y. The fracture temperature around a matrix block is thus very different depending on the fracture orientations. It can however be seen that the pressure front moves in a rather uniform manner and that the fracture pressure is also uniform around a matrix block, whatever the orientation of the fractures.

Figure 7:
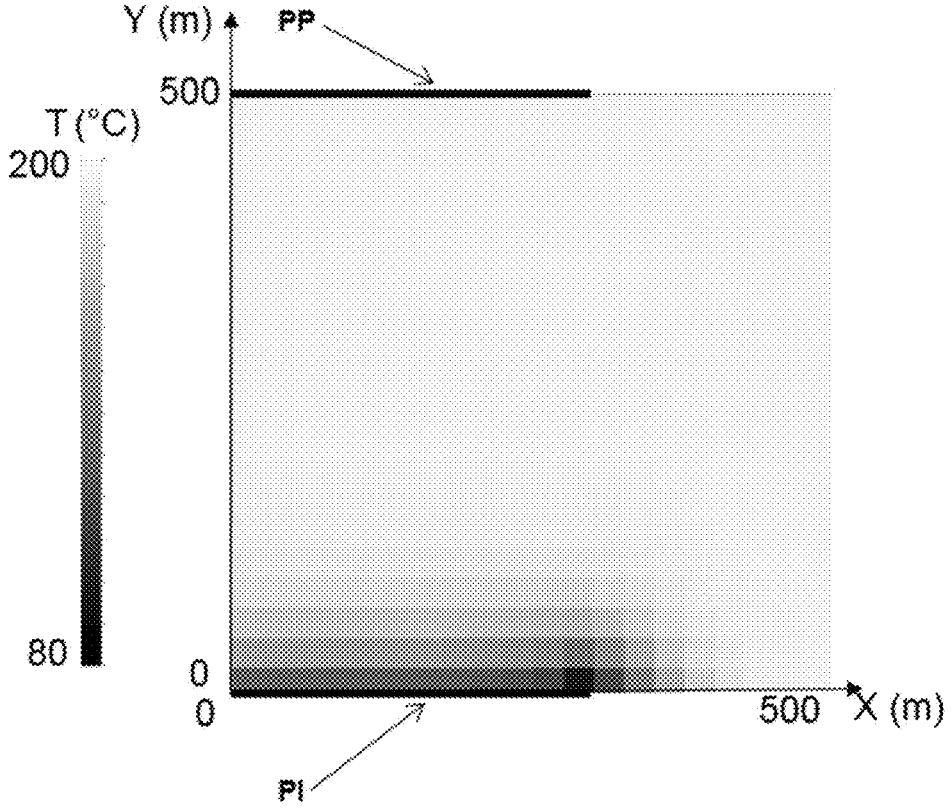
FIG. 7 shows the variations of temperature T of the water in directions X and Y, determined using a porosity model according to the prior art in the fracture medium, after 1000 days.

FIG. 7 shows the variations of temperature T of the water in directions X and Y determined by the dual porosity model according to the prior art in the fracture medium, after 1000 days. It can be seen in this figure that the temperature front moves slowly from injection well PI to production well PP. In fact, in the reference model, the heat exchange between the Y fractures and a matrix block is relatively low, due to the small contact surface. The matrix cannot provide enough heat to heat the moving cold water. However, with the dual porosity model according to the prior art, the matrix-fracture exchange occurs uniformly with all the fractures surrounding the matrix block. The exchange with the fractures in direction X is more significant than with the fractures in direction Y because the contact surface is larger with the fractures parallel to direction X. In other words, the dual porosity model according to the prior art greatly overestimates the heat exchange between matrix and fractures in this example. Therefore, the cold water front cannot move very rapidly.

Figure 8A:
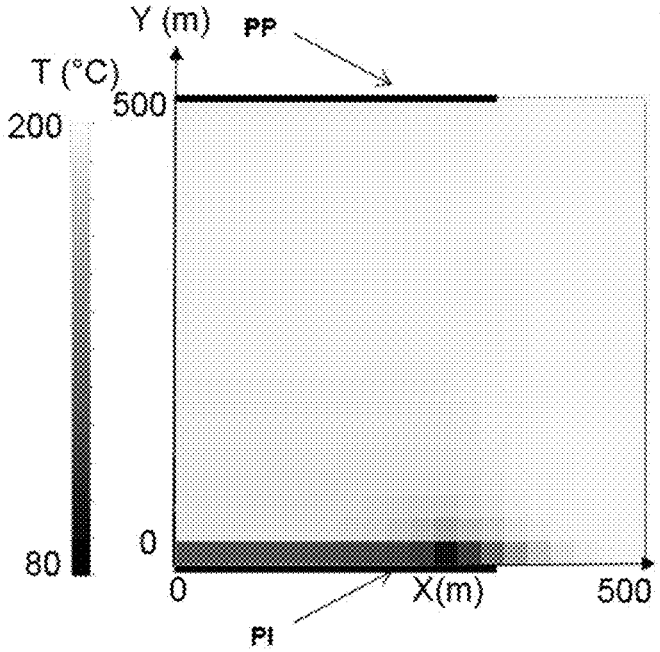
FIGS. 8A and 8B show the variations of temperature T of the water in directions X and Y, determined using a porosity model according to the invention, in the X-fracture medium (FIG. 8A) and in the Y-fracture medium (FIG. 8B), after 1000 days.
Figure 8B:
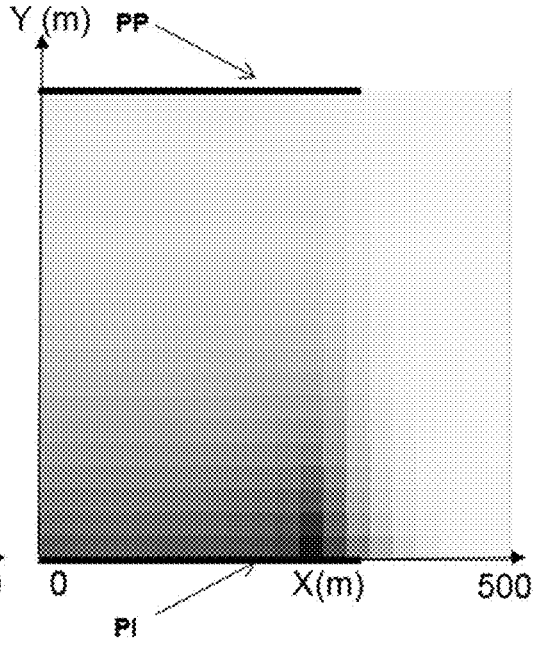
Figure 9A:
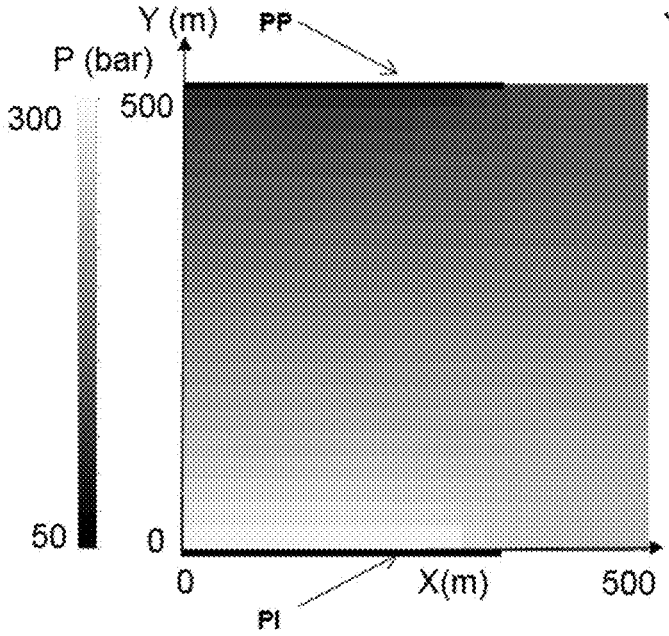
FIGS. 9A and 9B show the pressure variations of the water in directions X and Y, determined using a porosity model according to the invention, in the X-fracture medium (FIG. 9A) and in the Y-fracture medium (FIG. 9B), after 1000 days.
Figure 9B:
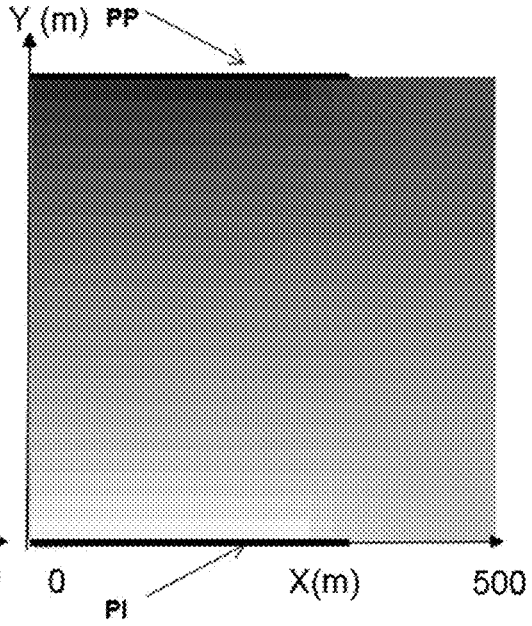

FIGS. 8A and 8B, (respectively 9A and 9B), show the variations of temperature T (respectively pressure P) of the water in directions X and Y determined using the dual porosity-dual fracture model according to the invention, in the X-fracture medium (FIG. 8A, respectively 9A,) and in the Y-fracture medium (FIG. 8B; respectively 9B), after 1000 days. It can be noted that, in the X-fracture medium, which represents the fractures oriented in direction X, the temperature front moves slowly from injection well PI to production well PP. This result is close to the temperatures in the fractures oriented along axis X predicted by the reference model. In the Y-fracture medium that represents the fractures oriented in direction Y, the cold temperature front moves rapidly, in a similar way (on average) to the front advancing in the fractures in direction Y of the reference model. Indeed, in the dual porosity-dual fracture model according to the invention, exchanges between a matrix block and the fractures oriented in direction X and direction Y are considered separately. Therefore, the thermal breakthrough can be predicted more accurately. Besides, as observed in FIGS. 9, left and right, the pressures in both X-fracture and Y-fracture media are nearly identical, and close to those predicted by the reference model, which clearly shows that the dual porosity-dual fracture model according to the invention is also suitable for modelling pressures.

Thus, the dual porosity-dual fracture model according to the invention enables more reliable simulation of fluid flows in fractured media wherein thermal exchanges through conduction are significant, in particular in the case of geothermal exploitation.

The invention claimed is:

1. A computer-implemented method of simulating fluid flows in an underground formation comprising a fracture network for exploiting the fluid of the underground formation wherein, from measured properties relative to the formation, a grid representation of the formation is constructed and at least one statistical parameter relative to the fracture network is determined, comprising steps of:

A) constructing from the at least one statistical parameter relative to the fracture network, a porosity model for the underground formation comprising the fracture network, the porosity model comprising a first medium representative of an unfractured matrix of the formation, a second medium representative of fractures of the formation oriented in a first direction, and a third medium representative of fractures of the formation oriented in a second direction, the first and second directions being orthogonal to one another;

B) determining from at least the measurements of properties relative to the formation, from the at least one statistical parameter relative to the fracture network and from the porosity model flow parameters in each cell of the grid representation, the flow parameters comprising:

determining between two neighboring cells in the second direction, a convection transmissibility and a conduction transmissibility of the fluid in the first and second directions in the second medium, the convection and conduction transmissibilities of the fluid being zero in the second direction in the second medium;

determining between two neighboring cells in the first direction, a convection transmissibility and a conduction transmissibility of the fluid in the first and second directions in the third medium, the convection and conduction transmissibilities of the fluid being zero in the first direction in the third medium; and determining within a cell of the grid representation, mass exchanges by convection, energy exchanges by conduction between the second and third mediums, between the first and second mediums, and between the first medium and the third medium; and C) simulating from the grid representation and the flow parameters in each cell of the grid, the flows of the fluid in the underground formation comprising the fracture network by use of a flow simulator implementing the porosity model.

2. A method as claimed in claim 1, wherein the mass exchanges $$F_{w,i}^{ff}$$

by convection between the second and third mediums in one of the cells i of the grid are determined with a formula:

$$F_{w,i}^{ff} = \lambda_i^f T_i^{ff} \left(P_i^{fX} - P_i^{fY}\right)$$

wherein $$T_i^{ff}$$

is a convection transmissibility between the second and third mediums of the cell i, $$P_i^{fX}$$

and $$P_i^{fY}$$

correspond to a pressure in the second and third mediums of the cell i respectively, and $$\lambda_i^f$$

is mobility of the fluid between the second and third mediums of the cell i.

3. A method as claimed in claim 1, wherein the energy exchanges $$F_{H,i}^{ff}$$

by convection between the second and third mediums in one of the cells i of the grid are determined with a formula:

$$F_{H,i}^{ff} = \lambda_i^f H_i^f T_i^{ff} \left(P_i^{fX} - P_i^{fY}\right)$$

wherein $$H_i^f$$

is a enthalpy of the fluid between the second and third mediums of the cell i, $$T_i^{ff}$$

is the convection transmissibility between the second and third mediums of the cell i, $$P_i^{fX}$$

and $$P_i^{fY}$$

correspond to the pressure in the second and third mediums of the cell i respectively, and $$\lambda_i^f$$

is the mobility of the fluid between the second and third mediums of the cell i.

4. A method as claimed in claim 2, wherein energy exchanges $$F_{H,i}^{ff}$$

by convection between the second and third mediums in one of the cells i of the grid are determined with a formula:

$$F_{H,i}^{ff} = \lambda_i^f H_i^f T_i^{ff} \left(P_i^{fX} - P_i^{fY}\right)$$

wherein $$H_i^f$$

is a enthalpy of the fluid between the second and third mediums of the cell i, $$, T_i^{ff}$$

is the convection transmissibility between the second and third mediums of the cell i, $$P_i^{fX}$$

and $$P_i^{fY}$$

correspond to the pressure in the second and third mediums of the cell i respectively, and $$\lambda_i^f$$

is the mobility of the fluid between the second and third mediums of the cell i.

5. A method as claimed in claim 2, wherein the convection transmissibility between the second and third mediums of the cell i is determined with a formula:

$$T_i^{ff} = \alpha \sum_{j \in \Omega_i} \left( T_{x,ij}^{fX} + T_{y,ij}^{fY} \right)$$

where α is a multiplier equal to at least 100, $\Omega_i$ is all cells next to cell i, $$T_{x,ij}^{fX}$$

corresponds to the convection transmissibility in the first direction in the second medium for the cell i, and $$T_{y,ij}^{fY}$$

corresponds to the convection transmissibility in the second direction in the third medium for the cell i.

6. A method as claimed in claim 3, wherein the convection transmissibility between the second and third mediums of the cell i is determined with a formula:

$$T_i^{ff} = \alpha \sum_{j \in \Omega_i} \left( T_{x,ij}^{fX} + T_{y,ij}^{fY} \right)$$

where α is a multiplier equal to at least 100, $\Omega_i$ is all cells next to cell i, $$T_{x,ij}^{fX}$$

corresponds to the convection transmissibility in the first direction in the second medium for the cell i, and $$T_{y,ij}^{fY}$$

corresponds to the convection transmissibility in the second direction in the third medium for the cell i.

7. A method as claimed in claim 1, wherein energy exchanges $$F_{D,i}^{ff}$$

by conduction between the second and third mediums in the cell i are determined with a formula:

$$F_{D,i}^{ff} = G_i^{ff} \left( \Theta_i^{fX} - \Theta_i^{fY} \right)$$

where $$G_i^{ff}$$

is conduction transmissibility between the second and third mediums for the cell i, $$\Theta_i^{fX}$$

and $$\Theta_i^{fY}$$

correspond to the temperature in the second and third mediums respectively.

8. A method as claimed in claim 2, wherein energy exchanges $$F_{D,i}^{ff}$$

by conduction between the second and third mediums in the cell i are determined with a formula:

$$F_{D,i}^{ff} = G_i^{ff} \left( \Theta_i^{fX} - \Theta_i^{fY} \right)$$

where $$\Theta_j^{ff}$$

is conduction transmissibility between the second and third mediums for the cell i, $$\Theta_i^{fX}$$

and $$\Theta_i^{fY}$$

correspond to the temperature in the second and third mediums respectively.

9. A method as claimed in claim 3, wherein energy exchanges $$F_{D,i}^{ff}$$

by conduction between the second and third mediums in the cell i are determined with a formula:

$$F_{D,i}^{ff} = G_i^{ff}(\Theta_i^{fX} - \Theta_i^{fY})$$

where $$G_i^{ff}$$

is conduction transmissibility between the second and third mediums for the cell i, $$\Theta_i^{fX}$$

and $$\Theta_i^{fY}$$

respectively correspond to the temperature in the second and third mediums.

10. A method as claimed in claim 4, wherein energy exchanges $$F_{D,i}^{ff}$$

by conduction between the second and third mediums in the cell i are determined with a formula:

$$F_{D,i}^{ff} = G_i^{ff}(\Theta_i^{fX} - \Theta_i^{fY})$$

where $$G_i^{ff}$$

is conduction transmissibility between the second and third mediums for the cell i, $$\Theta_i^{fX} \text{ and } \Theta_i^{fY}$$

respectively correspond to the temperature in the second and third mediums.

11. A method as claimed in claim 5, wherein energy exchanges $$F_{D,i}^{ff}$$

by conduction between the second and third mediums in the cell i are determined with a formula:

$$F_{D,i}^{ff} = G_i^{ff}(\Theta_i^{fX} - \Theta_i^{fY})$$

where $$G_i^{ff}$$

is conduction transmissibility between the second and third mediums for the cell i, $$\Theta_i^{fX}$$

respectively correspond to the temperature in the second and third mediums.

12. A method as claimed in claim 6, wherein energy exchanges $$F_{D,i}^{ff}$$

by conduction between the second and third mediums in the cell i are determined with a formula:

$$F_{D,i}^{ff} = G_i^{ff}(\Theta_i^{fX} - \Theta_i^{fY})$$

where $$G_i^{ff}$$

is conduction transmissibility between the second and third mediums for the cell i, $$\Theta_i^{fX}$$

and $$\Theta_i^{fY}$$

respectively correspond to the temperature in the second and third mediums.

13. A method as claimed in claim 12, wherein conduction transmissibility between the second and third mediums for the cell i is determined with a formula:

$$G_i^{ff} = \Lambda_i^{ff} C_i^{ff}$$

where $$\Lambda_i^{ff}$$

is an arithmetic mean of an effective thermal conductivity of the second and third mediums, $$C_i^{ff}$$

is a geometric coefficient depending on the dimensions of the cell i, the dimensions of one of the matrix blocks into which the first medium is broken, and the opening of the fractures of the second and third mediums.

14. A method as claimed in claim 8, wherein the conduction transmissibility between the second and third mediums for the cell i is determined with a formula:

$$G_i^{ff} = \Lambda_i^{ff} C_i^{ff}$$

where $$\Lambda_i^{ff}$$

is an arithmetic mean of an effective thermal conductivity of the second and third mediums, $$C_i^{ff}$$

is a geometric coefficient depending on the dimensions of the cell i, the dimensions of one of the matrix blocks into which the first medium is broken, and the opening of the fractures of the second and third mediums.

15. A method as claimed in claim 9, wherein conduction transmissibility between the second and third mediums for the cell i is determined with a formula:

$$G_i^{ff} = \Lambda_i^{ff} C_i^{ff}$$

where $$\Lambda_i^{ff}$$

is an arithmetic mean of an effective thermal conductivity of the second and third mediums, $$C_i^{ff}$$

is a geometric coefficient depending on the dimensions of the cell i, the dimensions of one of the matrix blocks into which the first medium is broken, and the opening of the fractures of the second and third mediums.

16. A method as claimed in claim 10, wherein conduction transmissibility between the second and third mediums for the cell i is determined with a formula:

$$G_i^{ff} = \Lambda_i^{ff} C_i^{ff}$$

where $$\Lambda_i^{ff}$$

is an arithmetic mean of an effective thermal conductivity of the second and third mediums $$C_i^{ff}$$

is a geometric coefficient depending on the dimensions of the cell i, the dimensions of one of the matrix blocks into which the first medium is broken, and the opening of the fractures of the second and third mediums.

17. A method as claimed in claim 11, wherein the conduction transmissibility between the second and third mediums for the cell i is determined with a formula:

$$G_i^{ff} = \Lambda_i^{ff} C_i^{ff}$$

where $$\Lambda_i^{ff}$$

is an arithmetic mean of an effective thermal conductivity of the second and third mediums, $$C_i^{ff}$$

is a geometric coefficient depending on the dimensions of the cell i, the dimensions of one of the matrix blocks into which the first medium is broken, and the opening of the fractures of the second and third mediums.

18. A method of exploiting a fluid of an underground formation comprising a fracture network, wherein the method as claimed in claim 1 is performed and, from at least simulation of the flows in the underground formation, an exploitation scheme comprising at least one site for at least one of an injection well and at least one production well is determined for the fluid, and the fluid of the underground formation is exploited at least by drilling the wells at the site and by providing wells with exploitation infrastructures.

19. A non-transitory computer-readable medium storing a computer program product which, when executed on a computer, implements the method as claimed in claim 1.

* * * * *